US005990600A

United States Patent [19]

Konishi et al.

[11] Patent Number: 5,990,600

[45] Date of Patent: Nov. 23, 1999

[54] EMISSIVE HEAT RADIATOR WITH SEMI-CYLINDRICAL HEAT RADIATING MEMBER

[75] Inventors: Takayoshi Konishi; Takeshi Azami, both of Tokyo, Japan

[73] Assignee: NEC Corporation, Tokyo, Japan

[21] Appl. No.: 08/932,559

[22] Filed: Sep. 19, 1997

[30] Foreign Application Priority Data

Sep. 19, 1996 [JP] Japan ..... 8-247777

[51] Int. Cl.[6] ..... H01J 7/24

[52] U.S. Cl. ..... 313/45; 313/40; 313/44; 165/80.2; 361/688

[58] Field of Search ..... 313/40, 44, 45, 313/21; 165/80.2, 80.1; 361/688; 315/3.5, 5.38

[56] References Cited

U.S. PATENT DOCUMENTS 2,629,836 2/1953 Deri ..... 313/44
2,958,797 11/1960 Mizuhara et al. ..... 313/21
3,426,230 2/1969 Derr ..... 313/44
5,260,623 11/1993 Bradatsch ..... 313/40

FOREIGN PATENT DOCUMENTS 0376827 7/1990 European Pat. Off. ..... H01J 23/033
0505862 9/1992 European Pat. Off. ..... H01J 23/033

OTHER PUBLICATIONS

W.R. House, "Cooling Down Weight", *Space*, Nov.–Dec. 1994, pp. 18–20.

*Primary Examiner*—Michael Day
*Attorney, Agent, or Firm*—Surhrue, Mion, Zinn, Macpeak & Seas, PLLC

[57] ABSTRACT

A plurality of a U-shaped heat radiation plates are provided on a heat radiating tube. These U-shaped plates have different sizes and elongated in the same direction so as to cross an axis of the tube. The emissive heat radiator may also includes at least one radiating plate 2 substantially perpendicular to each axis of the U-shaped plates. A concave surface of the U-shaped plate is subjected to a radiation surface processing, and a convex surface thereof is subjected to a reflection surface processing.

13 Claims, 16 Drawing Sheets

EMISSIVE HEAT RADIATOR WITH SEMI-CYLINDRICAL HEAT RADIATING MEMBER

BACKGROUND OF THE INVENTION

1. Field of the Invention

The present invention relates to the structure of a heat radiator for radiational cooling in a heat generating device, and more particularly to the structure of a heat radiator for radiational cooling which is suitable for use in a traveling-wave tube mounted on a satellite, etc.

2. Description of the Related Art

A traveling-wave tube is a device which accelerates electrons by a high voltage and converts a kinetic energy of electrons into an electromagnetic wave energy to amplify an electromagnetic wave.

FIG. 10 is a schematic cross-sectional view showing a traveling-wave tube. The traveling-wave tube is roughly made up of an electron gun section 7, a circuit section 8 and a collector section 9.

A high voltage is applied between an anode 12 and a cathode 10. Electrons 13 emitted from the cathode 10 are accelerated by the anode 12. Reference numeral 11 denotes a beam formation electrode, and reference numeral 4 denotes an insulating ceramic.

Electrons 13 having a large kinetic energy pass through a slow-wave circuit 16. A synchronous magnetic field for beam convergence is developed by a permanent magnet 14 for electron beam convergence and a magnetic pole 15. On the other hand, a signal inputted through an input window 17*a* is outputted from an output window 17*b* through the slow-wave circuit 16.

In the slow-wave circuit 16, the input signal from the input window 17*a* and the electrons 13 are interacted with each other in such a manner that a part of the kinetic energy of the electrons 13 is converted into the electromagnetic energy of the input signal. As a result, the kinetic energy of the electrons is reduced whereas the input signal is amplified. The amplified signal is outputted from the output window 17*b*.

The electrons 13 that have lost a part of kinetic energy are collected by a multi-stage collector electrode group 5 that constitutes a collector section 9. A first collector electrode 5*a* which is situated on the electron beam input side is applied with a relative high voltage, but the voltage is lowered toward the electron beam end side in such a manner that a fourth collector electrode 5*d* is applied with a voltage which is close to a voltage applied to the cathode 10.

With the above structure, electrons low in velocity are collected by the first collector electrode 5*a* whereas electrons high in velocity are collected by the fourth collector electrode 5*d*.

However, since the electrons 13 do not collide with the collector electrode group 5 at a velocity of 0, heat is always developed on the collector electrode group 5. The efficient radiation of the heat and the suppression of the collector temperature as low as possible are required for stable operation of the traveling-wave tube.

In particular, in the traveling-wave tube mounted on the satellite, heat must be radiated, as much as possible, directly toward space as much as possible, so that heat is not transmitted to the inside of the satellite. The effect of heat radiation due to radiation of the traveling-wave tube mounted on the satellite deeply depends on the structure of the heat radiator and the radiation coefficient $\epsilon$ of the surface of the heat radiator.

Also, since a plurality of tubular bulbs are disposed adjacent to each other on the satellite, a structure having a heat radiation directivity tends to become important in order to suppress heat interference of the respective tubular bulbs with each other as much as possible.

The prior art that takes the above circumstances into account will be described below.

FIGS. 11A, 11B and 12 show an example of the emissive heat radiator disclosed in Journal "Space", combined Nos. 11 and 12 of 1994, pp. 18 to 20.

FIGS. 11A and 11B are a front view and a side view of the emissive heat radiator, respectively, and FIG. 12 is a perspective view of the appearance of the emissive heat radiator. The emissive heat radiator is made up of a cylindrical section 18 and a plurality of radiating fins 19, where a collector is inserted into the cylindrical section 18.

A heat that flows into the cylindrical section 18 of the emissive heat radiator from a collector electrode is propagated to the radiating fins 19 due to heat conduction, and is then discharged to the exterior of the emissive heat radiator due to radiation from the radiating fins 19.

In this example, the radiating fins 19 are designed radially with respect to a center axis of the collector. Therefore, heat radiation have almost no directivity in both of radial and axial directions.

FIG. 13 shows an emissive heat radiator disclosed in U.S. Pat. No. 5,260,623, wherein two funnel-shaped sections 20, i.e., truncated cone-shaped projections and one annular disk-shaped section 26 are provided on a cylindrical section 3. A heat which flows into the cylindrical section 3 from a collector electrode inserted therein is propagated to the funnel-shaped sections 20 due to heat conduction, and is then radiated from the funnel-shaped sections 20. All surfaces of the sections 20 and 26, with the exception of the surface of the disk-shaped section 26 facing an arriving electron beam are characterized by high heat emission. In contrast, the surface of disk-shaped section 26 facing the arriving electron beam is designed as a surface with low heat emission.

The traveling-wave tubes on a satellite are arranged in such a manner that, as shown in FIG. 14, collector sections 22 (including an emissive heat radiator) are projected from the satellite 21 into a space and arranged adjacent to each other in a line. With the traveling-wave tubes thus arranged, a large number of traveling-wave tubes are mounted on the satellite, and heat generated from the collectors is radiated directly toward the space, to thereby make the cooling of the satellite efficient.

However, according to the prior arts shown in FIGS. 12 and 13, heat radiated laterally from each collector is absorbed by other collectors of the adjacent traveling-wave tubes, to thereby develop heat interference. As a result, the efficiency of radiational cooling is deteriorated.

SUMMARY OF THE INVENTION

The present invention has been made in view of the above circumstances, and therefore an object of the present invention is to provide a radiational cooling structure having a required directivity of heat radiation and a high cooling performance.

To achieve the above object, according to the present invention, there is provided an emissive heat radiator, comprising at least one substantially semi-cylindrical section which is U-shaped in cross section and elongated in a direction perpendicular to the cross section.

Also, the U-shaped cross section of the substantially semi-cylindrical section is constituted by one of a continuous curve consisting of a part of a quadratic surve, and the combination of straight lines.

The emissive heat radiator may further comprise at least one heat radiating plate perpendicular to an axis of the substantially semi-cylindrical section.

More preferably, an inner surface of the substantially semi-cylindrical section at its concave side is subjected to a radiation surface processing, and an outer surface thereof at its convex side is subjected to a reflection surface processing. In this construction, only a center portion of the outer surface at the convex side may be subjected to the radiation surface processing.

The emissive heat radiator is structured such that the reflection processed surface has a mirror coat made of TiN, and the radiation processed surface has an anodic oxide coat heaving a predetermined thickness and a predetermined maximum surface roughness.

Also, it is preferable that the emissive heat radiator disposed on the radiating section of a heat generating device such as a microwave tube, in particular, on a collector section of the traveling-wave tube of the satellite mounted type. In this situation, in the case where a plurality of traveling-wave tubes are located together, in order to suppress heat interference, the traveling-wave tubes are desirably disposed in such a manner that they are in parallel with a direction of elongation (axial direction) of the substantially semi-cylinder section of the emissive heat radiator which is attached to each of the adjacent collector sections.

In the prior arts shown in FIGS. 12 and 13, the heat radiation in a circumferential direction of the collector is unified regardless of angles, whereas the present invention has the directivity of heat radiation not only in an axial direction but also in the circumferential direction.

Specifically, the heat radiation toward the adjacent traveling-wave tube side is restricted. Also, it is needless to say that the heat radiation toward the satellite side is restricted. However, the heat radiation toward other sides is not restricted. Therefore, the directivity is not restricted backward of the collector (a space side) and in a direction along which no traveling-wave tube is disposed (or in a direction far from the traveling-wave tube) so that heat can be freely radiated. Thus, the emissive heat radiator according to the present invention has wide directivity of heat radiation.

Since the emissive heat radiator according to the present invention has the wide directivity, the effective radiation area can be made large with the result that it has a high cooling performance.

BRIEF DESCRIPTION OF THE DRAWINGS

These and other objects, features and advantages of the present invention will become more fully apparent from the following detailed description taken with the accompanying drawings in which:

FIGS. 3A to 3C are cross-sectional views showing a semi-cylindrical heat radiator section according to a modified example of the present invention taken vertically along a cylindrical axis, in which FIG. 3A shows a part of a parabolic portion, FIG. 3B shows a part of a circular portion, and FIG. 3C shows a part of a polygonal portion, respectively;

FIGS. 9A to 9C are cross-sectional views showing a semi-cylindrical heat radiator according to the sixth embodiment of the present invention, in which FIG. 9A is a cross-sectional view showing a parabolic portion, FIG. 9B is a cross-sectional view showing a circular portion, and FIG. 9C is a cross-sectional view showing a polygonal section, respectively;

FIGS. 11A and 11B show an example of a conventional emissive heat radiator, in which FIG. 11A shows its front view, and FIG. 11B shows its side view.

DETAILED DESCRIPTION OF THE PREFERRED EMBODIMENTS

Figure 1:
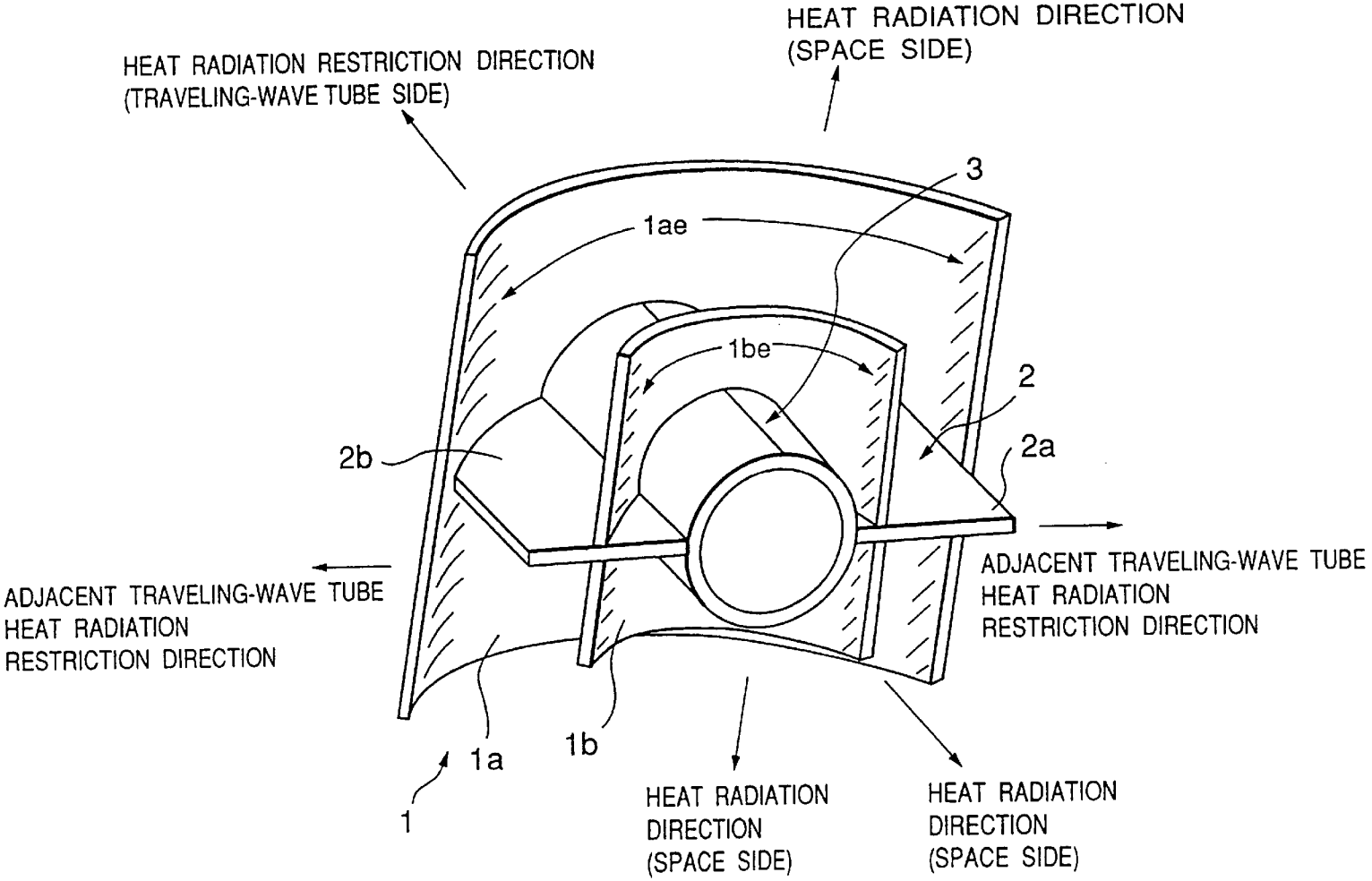
FIG. 1 is a perspective view showing an emissive heat radiator according to the first embodiment of the present invention.

Referring to FIG. 1, a cylindrical radiator 3 is provided with a pair of substantially semi-cylindrical radiators 1 on an outer surface thereof. One of the semi-cylindrical radiators is a large U-shaped plate 1*a* and the other one is a small U-shaped plate 1*b*. Both of them are arranged so as to extend in a direction perpendicular to an axis of the cylindrical radiator 3 which has a hollow space to accommodate a collector of a traveling-wave tube (not shown).

A radiated heat from the cylindrical radiator 3 is partially suppressed by side edge regions 1*ae* and 1*be* extending along each axis of the semi-cylindrical radiators 1*a* and 1*b*. But the radiated heat from the cylindrical radiator 3 in an axial direction of the semi-cylinder is not suppressed.

Furthermore, it is preferable to provide a reflection treatment on each convex surface of the U-shaped plates 1*a* and 1*b* to suppress the emissive heat radiation toward a traveling-wave circuit side and adjacent traveling-wave tube.

A pair of radiating flat plates 2*a* and 2*b* are fixed to the cylindrical radiator 3 so as to extend along a central axis of the collector and thereby bridging a pair of U-shaped plates 1*a* and 1*b*. The radiating flat plates 2*a* and 2*b* radiate heat mainly in an axial direction of the semi-cylinder or U-shaped plates 1*a* and 1*b* but almost do not radiate heat in a direction perpendicular to the axis of the U-shaped plates 1*a* and 1*b*.

Also, the cylindrical radiator 3 may include a cylindrical radiator located at the back side of the collector of the traveling-wave tube.

Figure 2:
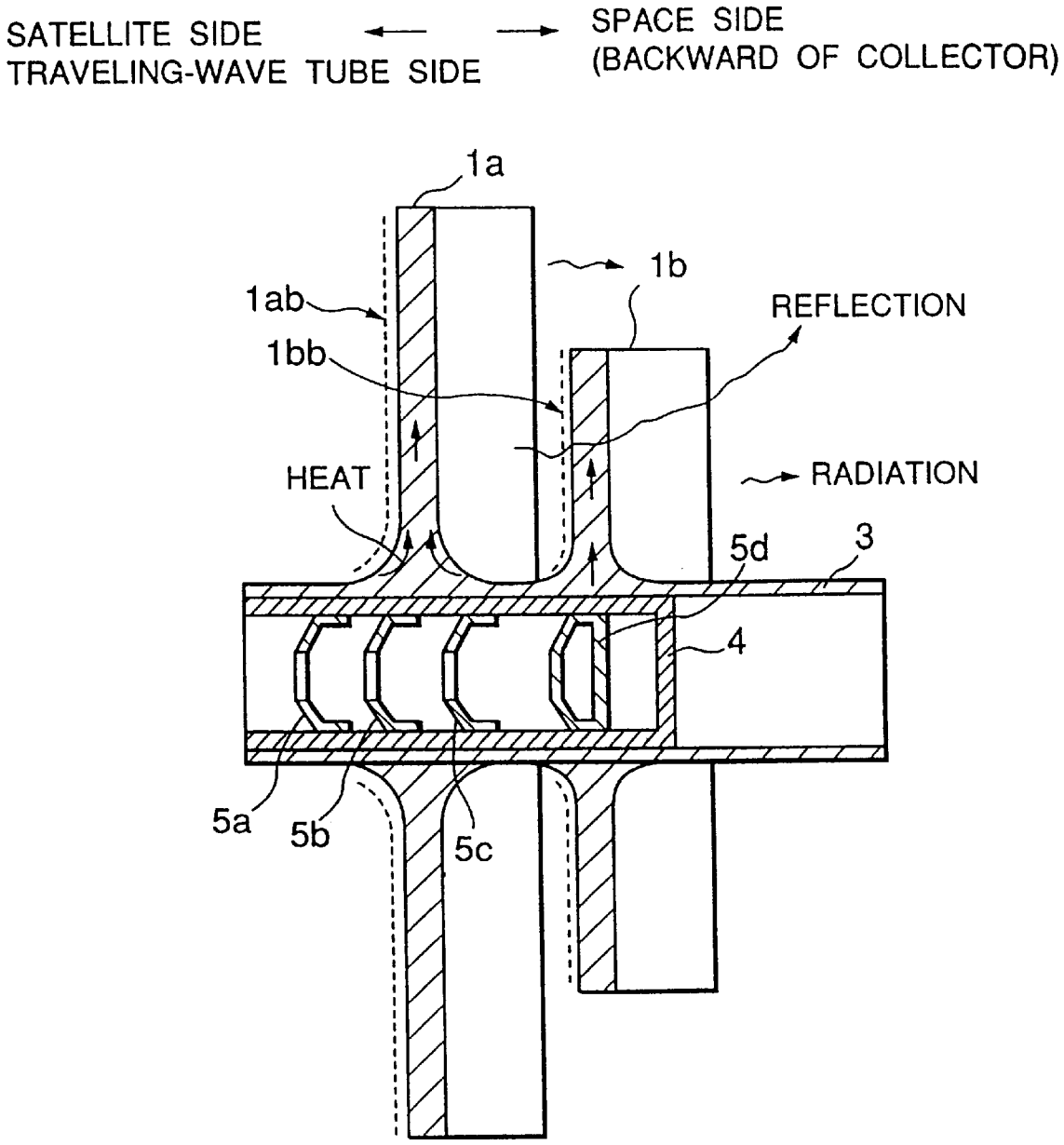
FIG. 2 is a cross-sectional view showing a case in which the emissive heat radiator according to the first embodiment of the present invention is attached to a collector.

In FIG. 2, a radiating flat plate 2*a* is not seen because it is located behind the cylindrical radiator 3. A plurality of collector electrodes 5*a* to 5*d* of the traveling-wave tube are supported by an insulative tube 4 and accommodated in the cylindrical radiator 3.

The semi-cylindrical radiator 1*b* backward of the collector (a space side, that is, a right side on the drawing) is smaller than the semi-cylindrical radiator 1*a* on a satellite side (a traveling-wave tube side, that is, a left side on the drawing).

The semi-cylindrical radiator 1*b* backward of the collector is located above an electrode 5*d* at the backmost (space side) of multi-stage collector electrodes, receives heat from the electrode 5*d*, and propagates heat to the semi-cylinder 1*b* due to heat conduction so that it radiates emissive heat toward the space from the concave surface of the semi-cylinder.

The semi-cylindrical radiator 1*a* on the circuit side is disposed in the vicinity of electrodes 5*a* to 5*c* other than the electrode 5*d* which is at the backmost (space side) of the multi-stage collector electrodes. The semi-cylindrical radiator 1*a* propagates heat from those electrodes to the inside of the semi-cylindrical radiator 1*a* due to heat conduction so that it radiates heat from the concave surface of the semi-cylinder toward the space.

When a convex surface 1*bb* of the semi-cylindrical radiator 1*b* backward of the collector (the space side) is subjected to a reflection surface processing, the radiation heat from the semi-cylindrical radiator 1*a* is reflected and thus radiation efficiency is increased.

Therefore, the semi-cylindrical radiator 1*a* on the circuit side is set to be larger in size than the semi-cylindrical radiator 1*b* on the space side so that an energy radiated by the radiator 1*a* is radiated directly toward the space as much as possible by reducing the size of the radiator 1*b*.

When the convex surface lab of the semi-cylindrical radiator 1*a* is subjected to a reflection surface processing, heat radiation toward the circuit side is suppressed enough.

In such a way, since the convex surfaces of the semi-cylindrical radiators 1*a* and 1*b* are subjected to the reflection surface processing, the heat radiation from those surfaces is very little. Therefore, the heat is hardly radiated from the convex surface toward the adjacent traveling-wave tube, and even if the heat from the adjacent traveling-wave tube is radiated, it is reflected without being absorbed.

The root portions of the semi-cylindrical radiators 1*a* and 1*b* are thickened so that they propagate heat from the collector electrode to the inside of the semi-cylindrical radiator as much as possible.

Also, toward the radiating flat plates 2*a* and 2*b* of FIG. 1, heat flows in from all the collector electrodes.

The root portions of the radiating flat plates 2*a* and 2*b* are also thickened, and the radiating flat plates 2*a* and 2*b* propagate heat to the inside of the radiating flat plates 2*a* and 2*b* due to heat conduction, and radiate heat mainly toward the axial direction of the semi-cylindrical radiators 1*a* and 1*b* due to radiation.

The reflection surface of the heat radiator in the traveling-wave tube of the satellite mounted type preferably satisfies as <0.10. The absorption factor of sunlight is one of parameters that evaluate the absorption factor of heat, and the lowered absorption factor of sunlight frankly represents that the reflection factor is high. In other words, in realizing the directivity of heat radiation, that the absorption factor as of sunlight is lower than 0.10, which represents that reflection of 90% is enabled, is more desirable.

Figure 15:
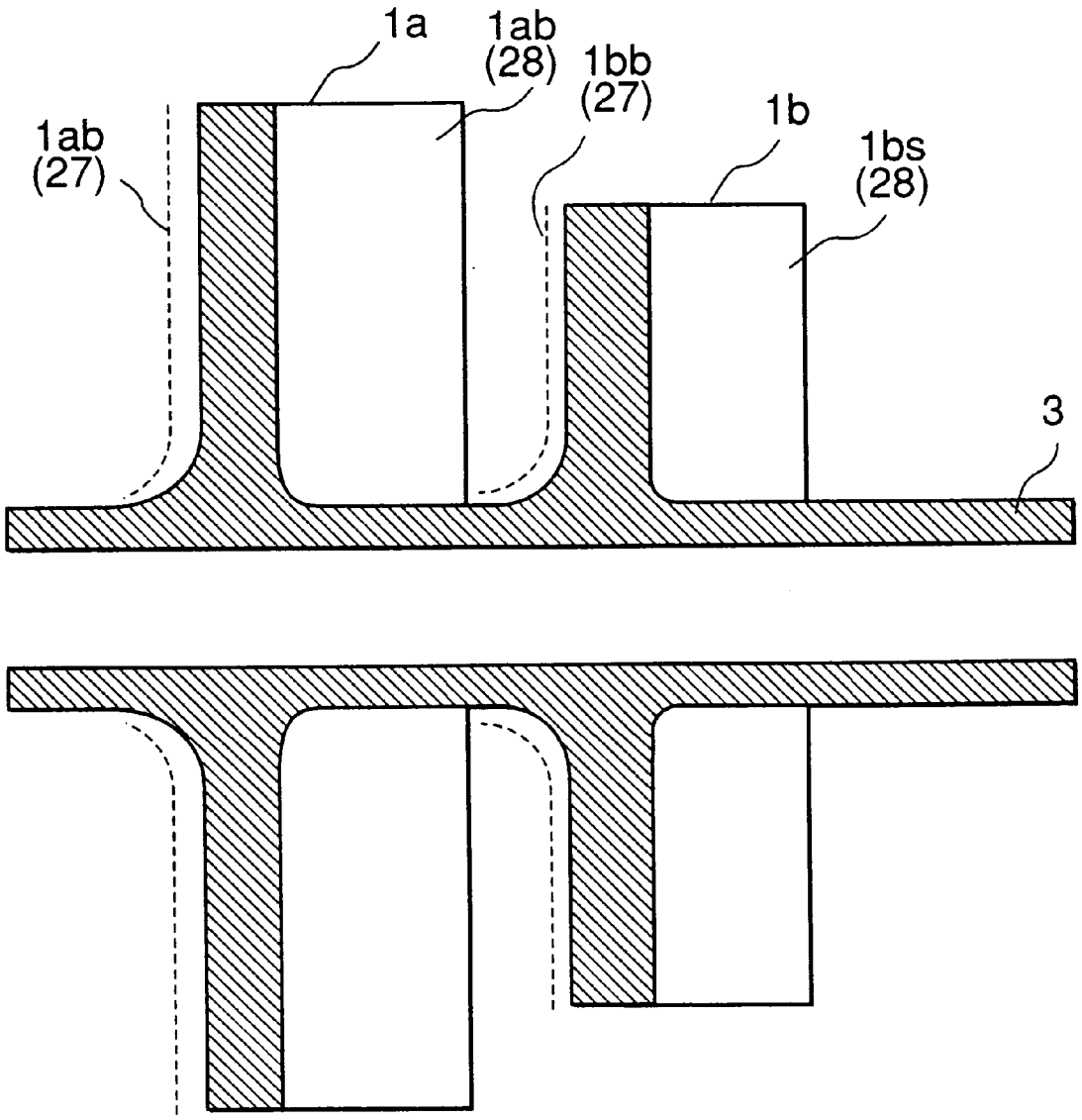
FIG. 15 is a cross-sectional view showing a radiation surface processing and a reflection surface processing according to an embodiment of the present invention.

FIG. 15 shows a relation between a cross-sectional view according to this embodiment of the present invention and the surface processing specification. After the convex outer surface of the semi-cylindrical radiators 1*a* and 1*b* is subjected to, for example, a surface grinding process, a reflection processed surface having a TiN coat 27 is formed on the convex outer surface through an ion plating process, to thereby suppress the radiation of heat toward the traveling-wave circuit side and the adjacent traveling-wave tube. The mirror coat of the TiN coat 27 is implemented through ion plating as follows.

First, in order to obtain the smoothing property on the surface of the aluminum alloy (JIS 6061) substrate, the surface is subjected to a mechanical surface grinding process to form a mirror surface of 0.1 $\mu$m or less in the maximum surface roughness Rmax. After a grease removing process, argon gas is introduced in vacuum, and sputtering of argon ions is conducted to enhance cleaning degree of the surface. Thereafter, ion plating of the TiN film is implemented. Because the ion plating is conducted in a relatively high pressure region such that the film forming condition is 0.01 to 0.002 Torr, the evaporated atoms of Ti collide with molecules of nitrogen gas and scattered, and also ions are accelerated toward an electric field. Therefore, the round-about of ions becomes excellent.

Since the TiN film formed through the ion plating like this can be coated while the surface contour of an under substrate is kept, the TiN film having the mirror state of 0.1 $\mu$m or less in the maximum surface roughness can be obtained. Since the TiN film thus reflection surface processed provides a mirror film, the reflection factor is high to the degree of 90% or more. That is, since the absorption factor is as <0.1, 10%, the radiation from the convex outer surface is suppressed.

As the ion plating type using the method of forming the TiN coat, there are reactive ion plating, arc type ion plating, sputtering type ion plating, follow cathode type ion plating, etc., but the ion plating type is not limited to those plating.

There has been known that the coat formed through the ion plating has the leveling effect, that is, serves to make the smoothing property of the surface constant, even in case of the fine roughness of the surface, in comparison with the coat formed through the wet type represented by plating.

Also, since the radiator of the present invention is actuated in a space, the ion plating type that obtains a coat in a vacuum state is suitable without a fear such as gas discharge.

On the other hand, it is desirable that the radiating surface of the radiator (the concave surface of the semi-cylindrical radiators 1*a* and 1*b*, the outer surface of the radiating plate 2, and the outer surface of the cylindrical radiator 3) is subjected to a radiation processing.

According to the applicant's own study, with a tendency to make an output of the traveling-wave tube of the satellite mounted type higher, it has been proved that the radiation factor characteristic as required is that the radiation factor $\epsilon$ is 0.90 or more for stable operation for a long period of time. That study is disclosed in detail in the applicant's specification of U.S. patent application Ser. No. 08/829,200. That is, through a variety of experiments using a plate made of a JIS 5052 aluminum alloy, the radiation factor of 0.90 or more is achieved by increasing the thickness of an anodic oxide film to be 45 μm or more.

According to the applicant's study, regarding the upper limit of the advantage obtained by the anodic oxide process, the maximum radiation efficiency of 0.93 is realized when the maximum surface roughness is 18 to 20 microns, and the thickness of the anodic oxide coat which has been subjected to sealing is 60 microns as will be described later.

It should be noted that when the thickness of the anodic oxide coat exceeds 65 microns, a micro-crack may occur. Thus, the limit of the coating thickness is 60 microns from the view point of the reliability.

Also, the radiation factor characteristic rises 0.02 to 0.03 by subjecting the anodic oxide coat to sealing regardless of the thickness of the anodic oxide coat and the surface roughness. The surface state of the anodic oxide coat which has been subjected to sealing is formed into fine needle-like shapes because fine sealed holes are grown. Accordingly, even if the thickness of the anodic oxide coat is about 45 μm, the radiation factor characteristic $\epsilon$ can satisfy the condition of $\epsilon \geqq 0.90$. When the sealing process is omitted, the thickness of the anodic oxide coat should be 50 μm or more to satisfy radiation factor characteristic $\epsilon \geqq 0.90$.

More in detail, as the countermeasure of improving the radiation factor characteristic of the cylindrical concave surface, that is, the radiating surface which is made of a JIS A6061 aluminum alloy, after the radiating surface is subjected to a blast process using a turbidity solution consisting of alumina powder and water in such a manner that the radiating surface has the surface roughness of 12 μm to 14 μm at the maximum Rmax, the anodic oxidizing process is implemented on the surface to provide an anodic oxide coat of 50 μm in thickness and 12 μm or more in the maximum surface roughness.

Figure 16:
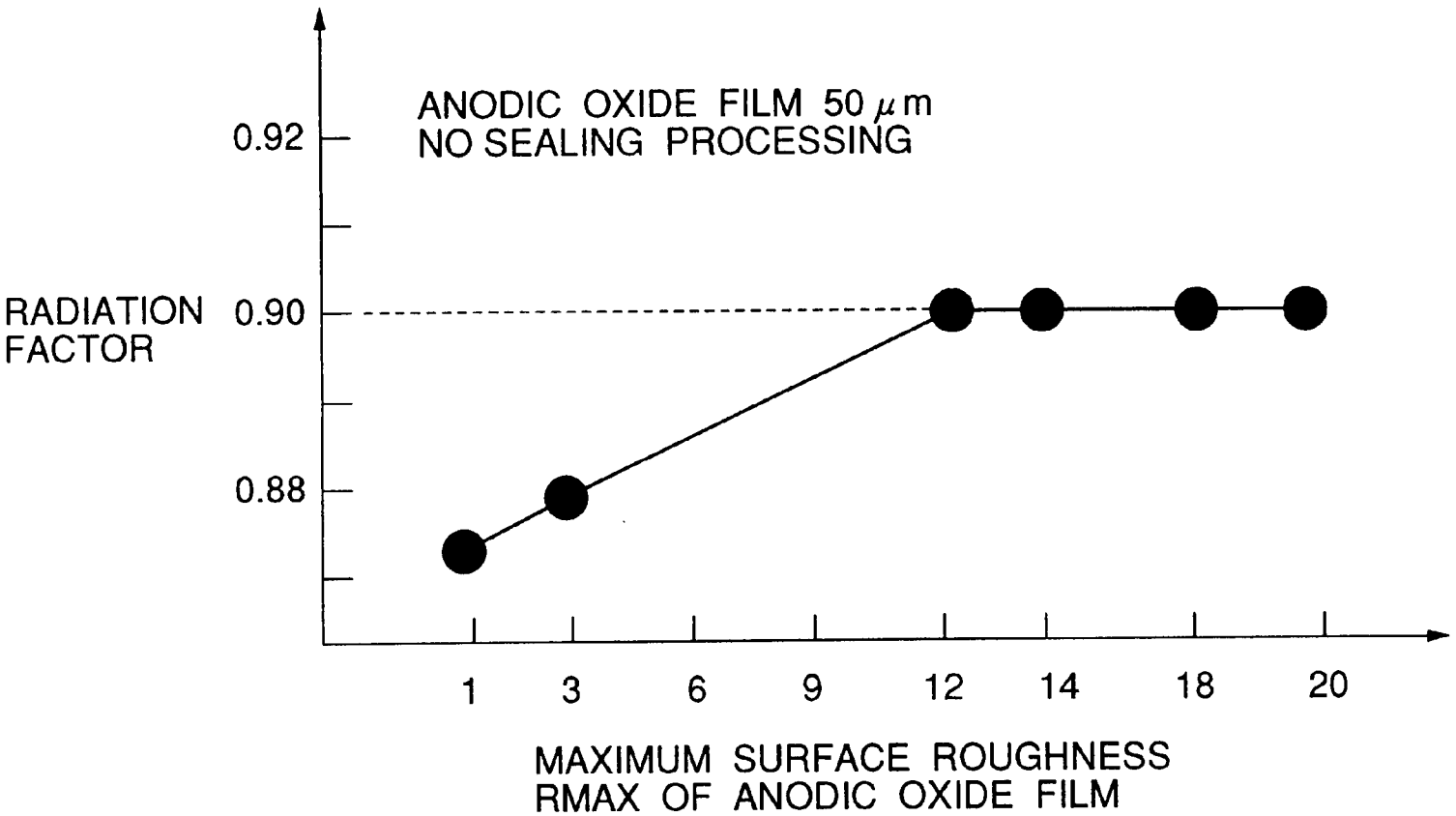
FIG. 16 is a graphs representing a relation between the maximum surface roughness and the radiation factor in an anodic oxide coat 50 $\mu$m (no sealing process).

In this example, a relation between the maximum surface roughness and the radiation factor of the anodic oxide coat 50 microns is shown in FIG. 16. In other words, with the structure having 12 microns or more in the maximum surface roughness in addition to a predetermined anodic oxide coat, the efficiency of 90% in radiation factor can be realized.

Subsequently, an anodic oxide processing technique will be described.

The anodic oxide process was conducted through the sulfuric acid method, and was implemented in 10% sulfuric acid aqueous solution in volume ratio at 0° C. The process was conducted under the electrolyte condition where current was 5A and a processing period was 30 minutes.

The radiation factor characteristic of the radiating surface according to the embodiment of the present invention achieved $\epsilon=0.92$, thus satisfying the radiation factor characteristic of the traveling-wave tube of the satellite mounted type.

FIG. 16 shows a relation between the maximum surface roughness and the radiation factor of the anodic oxide coat of 50 microns. In this example, the reason why the maximum surface roughness Rmax is 12 μm or more is because it has been found that the characteristic that the radiation factor $\epsilon \geqq 0.9$ cannot be satisfied even if the anodic oxide coat is provided in the case where the maximum surface roughness of the anodic oxide film is less than 12 μm, as shown in FIG. 16.

As is described above, with the arrangement of the traveling-wave tube such that the semi-cylindrical radiator structures of the emissive heat radiator according to the present invention become in parallel with each other, the heat radiation toward the adjacent traveling-wave tube on the satellite is eliminated, to thereby prevent mutual heat interference with the traveling-wave tubes.

Figure 3A:
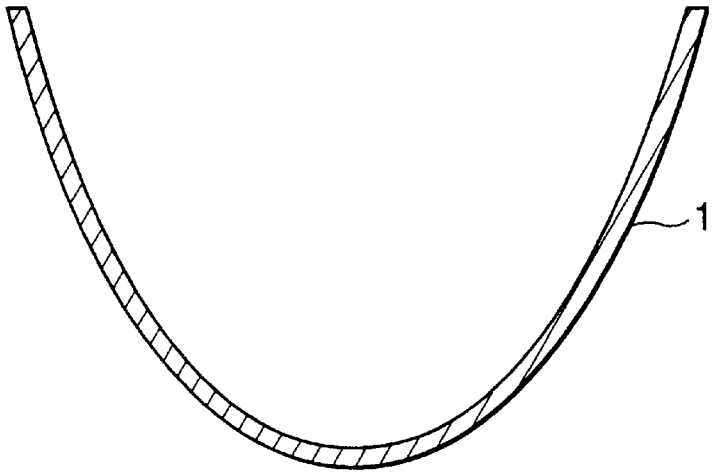
Figure 3B:
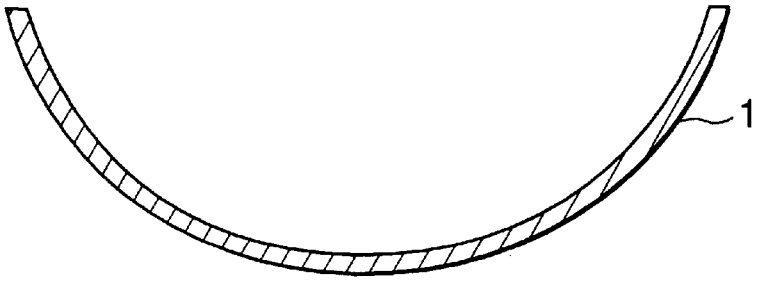
Figure 3C:
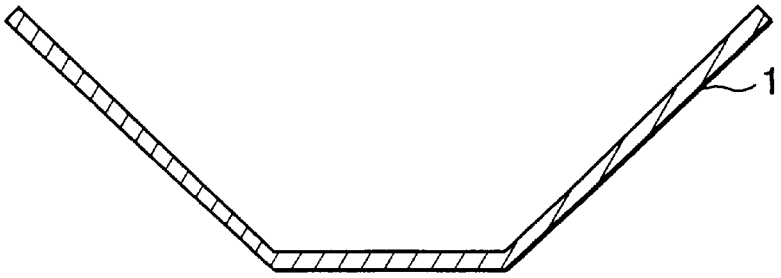

Also, the sectional contour of the semi-cylindrical radiators 1*a* and 1*b* may be formed by a part of a two-dimensional curve such as a circle, an ellipse, or a parabola, or alternatively it may be formed by a polygonal line. Examples like this are shown by cross-sectional views of the semi-cylinder shown in FIGS. 3A to 3C, respectively. FIGS. 3A, 3B and 3C are made up of a part of a parabola, a part of a circle and a polygonal line, respectively.

The emissive heat radiator of the present invention need be rigidly fixed onto a case substrate of the traveling-wave tube in such a manner that it withstands vibrations developed when launching a satellite. However, when a high temperature portion of the emissive heat radiator is supported by a large area and attached onto the case substrate, heat escapes from the emissive heat radiator to the traveling-wave tube, to thereby deteriorating a cooling efficiency. To cope with such problem, portions far apart from the semi-cylindrical radiator 1*a* or the collectors of the radiating plates 2*a* and 2*b* (for example, four corners of a surface (a convex surface) of the semi-cylindrical radiator 1*a* on the traveling-wave tube circuit side in FIG. 1) may be supported by a support member (not shown), whereby it may be fixed onto the substrate of the traveling-wave tube. The portions which are relatively low in the temperature of the emissive heat radiator are fixed onto the support with a small contact area, to thereby prevent heat generated from the collector to be returned to the traveling-wave tube.

Now, a description will be given of a second embodiment of the present invention.

Figure 4:
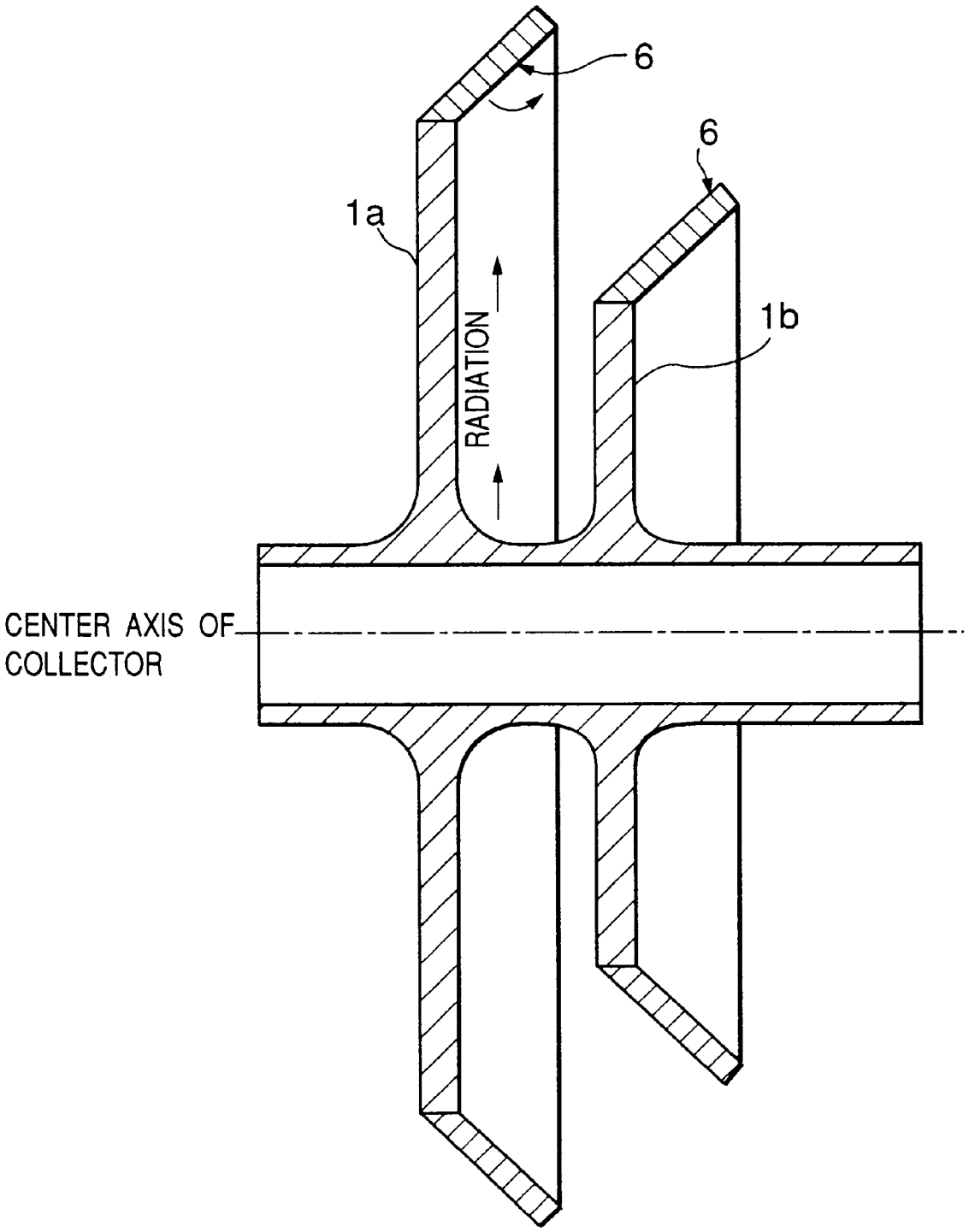
FIG. 4 is a cross-sectional view showing a heat radiator according to the second embodiment of the present invention.
Figure 5:
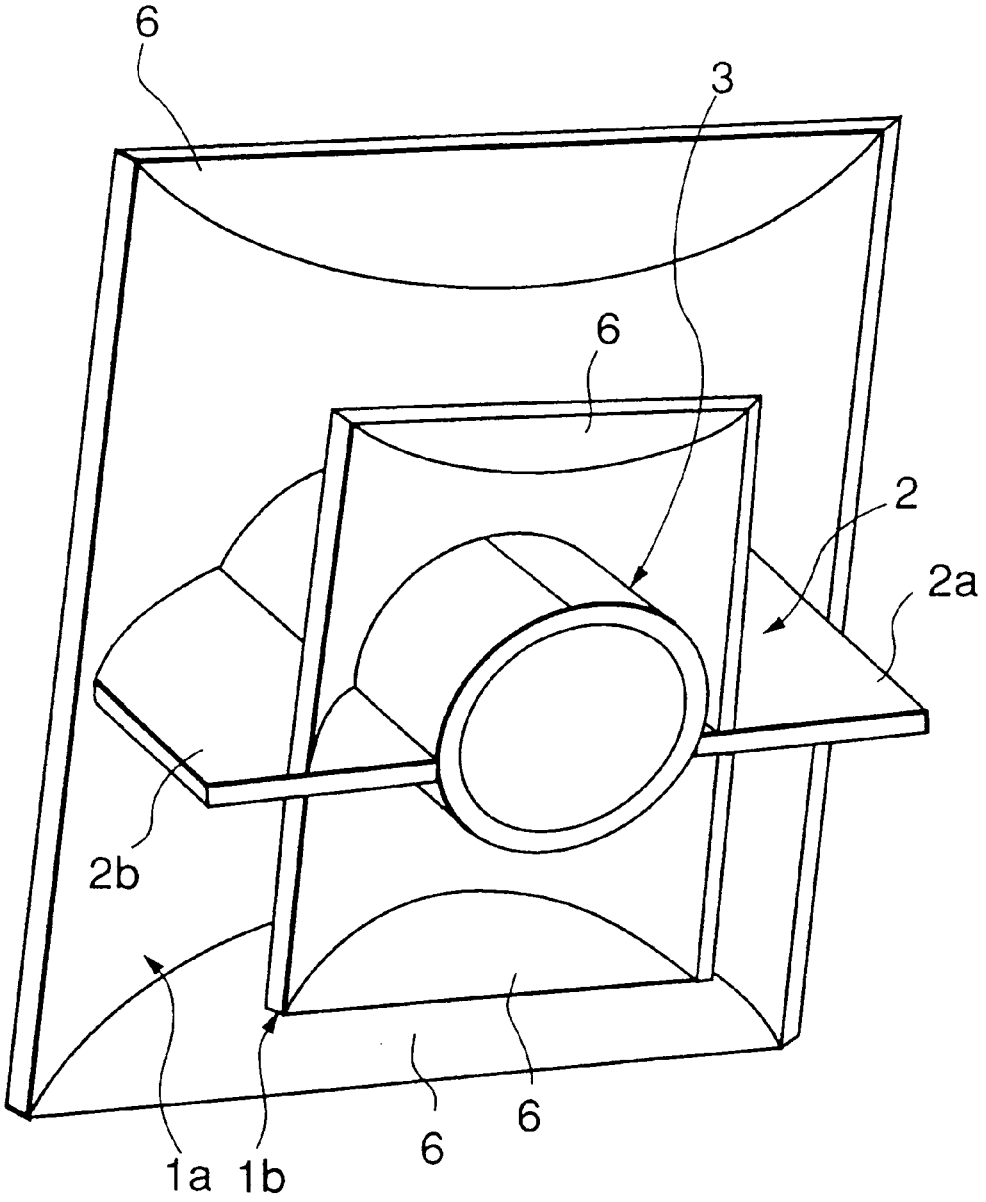
FIG. 5 is a perspective view showing an appearance of the heat radiator shown in FIG. 4.

In an example shown in FIGS. 4 and 5, reflection plates 6 are attached in the form of a visor onto both ends of the semi-cylindrical radiators 1*a* and 1*b* with an angle with respect to the axes of the semi-cylindrical radiators. Both surfaces of the reflection plate 6 are subjected to a reflection surface processing due to a TiN coat or the like.

With the above structure, even if another traveling-wave tube is disposed adjacent to a subject one in the axial direction of the semi-cylinder, because the radiation energy in the axial direction of the semi-cylinder is reflected by the both-side reflection plate 6 toward space, the heat interference of the adjacent traveling-wave tube is suppressed.

Also, even with the structure where the radiating flat plate 2 is separated by the semi-cylindrical radiator portions 1*a* and 1*b*, both the radiating plates of the semi-cylindrical radiation portions 1*a* and 1*b* are rotated at 90° with respect to an axis of a tube, and the both-side reflection plate 6 is attached onto the portion 1*a*, similar advantages of those in FIGS. 4 and 5 are obtained.

Figure 6:
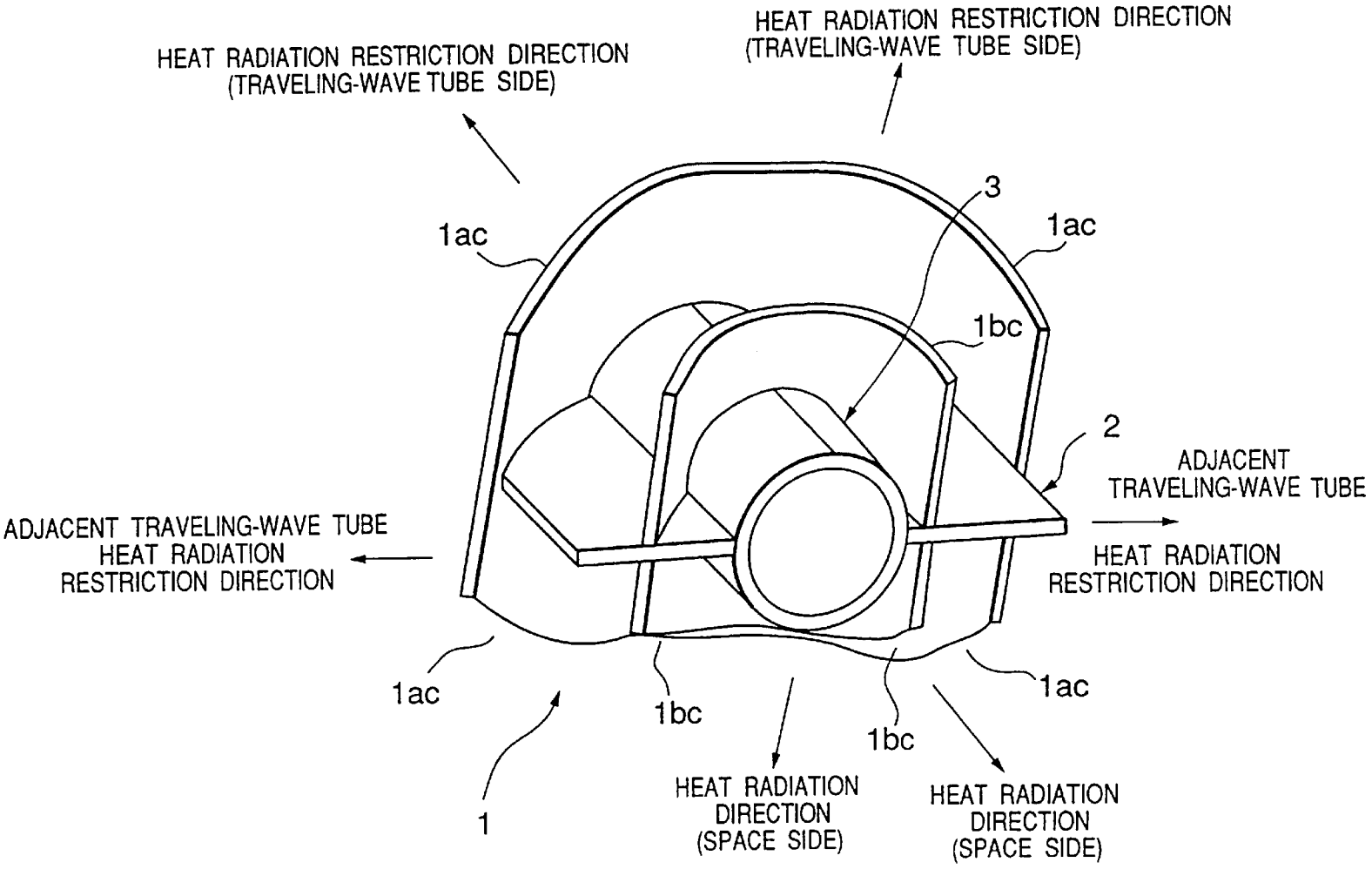
FIG. 6 is a perspective view showing an appearance of a heat radiator according to the third embodiment of the present invention.

Furthermore, a third embodiment of the present invention is shown in FIG. 6. Four corners 1*ac*, 1*bc* of the semi-cylindrical radiators 1*a* and 1*b* are relatively low in temperature and small in heat radiation. Also, those four corners of the semi-cylindrical radiator contribute little to the prevention of the heat radiation toward the adjacent traveling-wave tube. For that reason, those four corners are cut and rounded to reduce the weight of the radiator.

Figure 7:
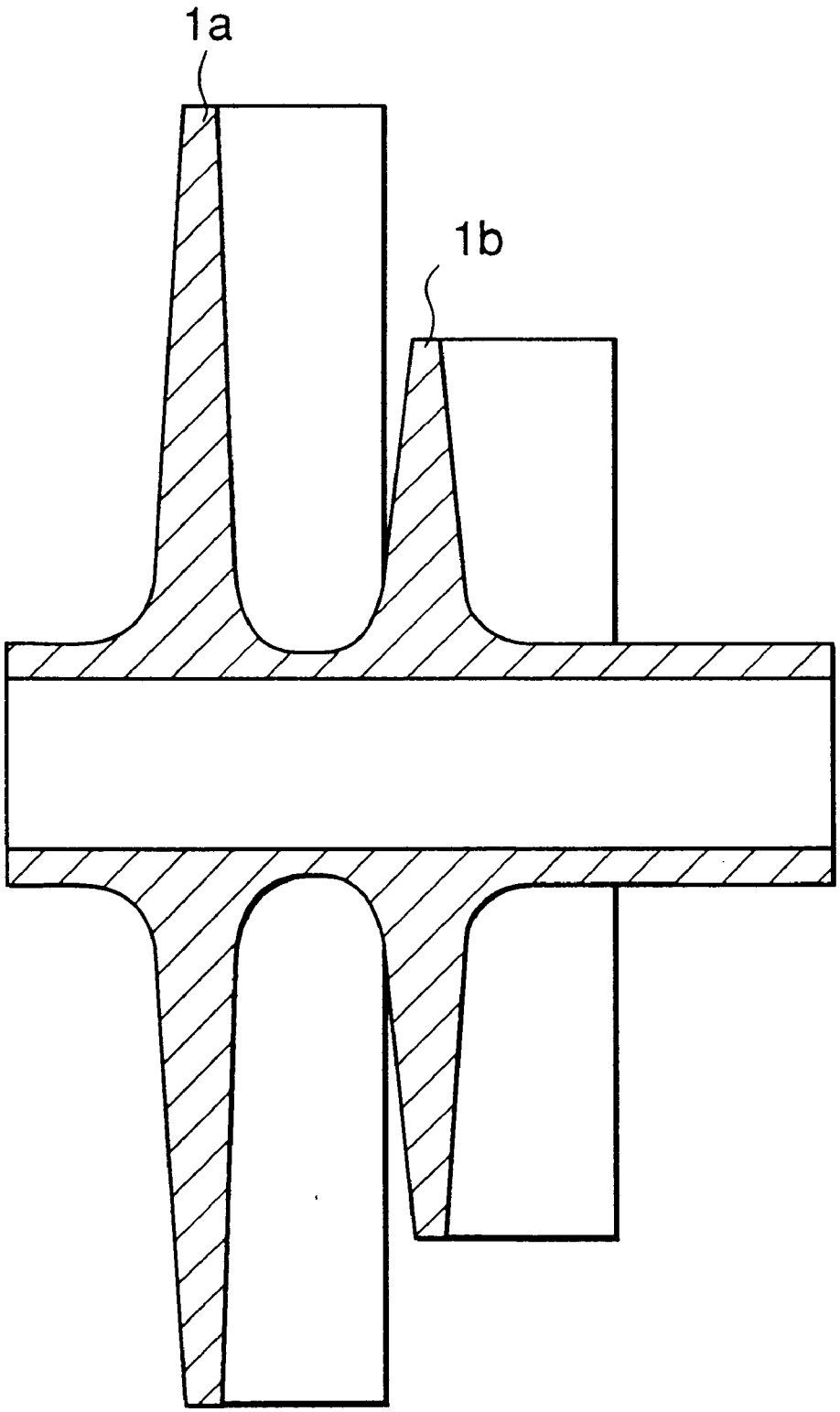
FIG. 7 is a cross-sectional view showing a heat radiator according to the fourth embodiment of the present invention.

FIG. 7 is a cross-sectional view showing a semi-cylindrical radiator according to a fourth embodiment of the present invention. Each semi-cylindrical surface is inclined to make it hard to retain heat between the semi-cylinders 1*a* and 1*b*, thereby enhancing heat radiation effect.

Figure 8:
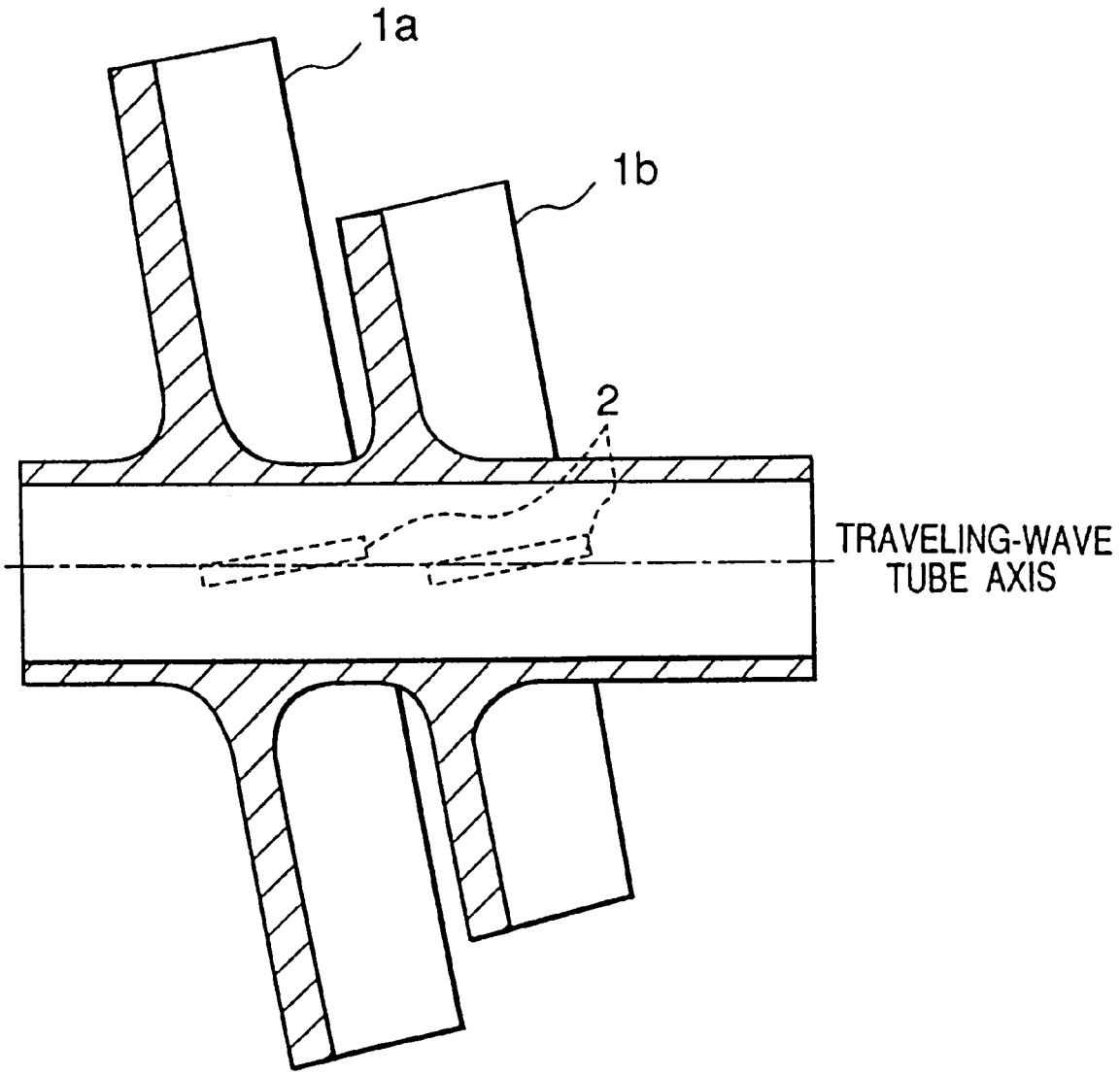
FIG. 8 is a cross-sectional view showing a heat radiator according to the fifth embodiment of the present invention.

FIG. 8 shows a fifth embodiment of the present invention, in which semi-cylindrical radiators 1*a*, 1*b* and a radiating flat plate 2 are rotated such that they are inclined with respect to an axis of the traveling-wave tube. With this structure, the direction of the directivity of heat radiation can be arbitrarily controlled.

Also, according to the seventh embodiment, it is proposed that the entire convex surface of the semi-cylindrical radiator 1*b* in the space is not subjected to the reflection surface processing such as gold plating or the like, but only a part of the convex surface is subjected to the reflection surface processing.

Figure 9A:
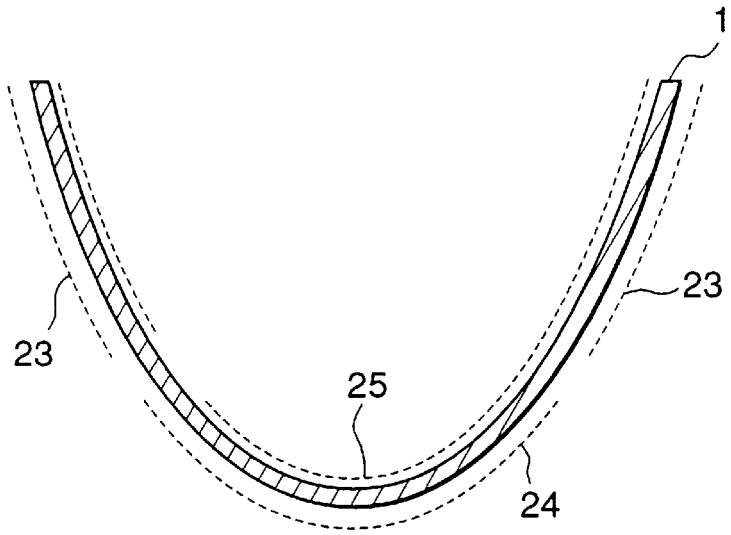
Figure 9B:
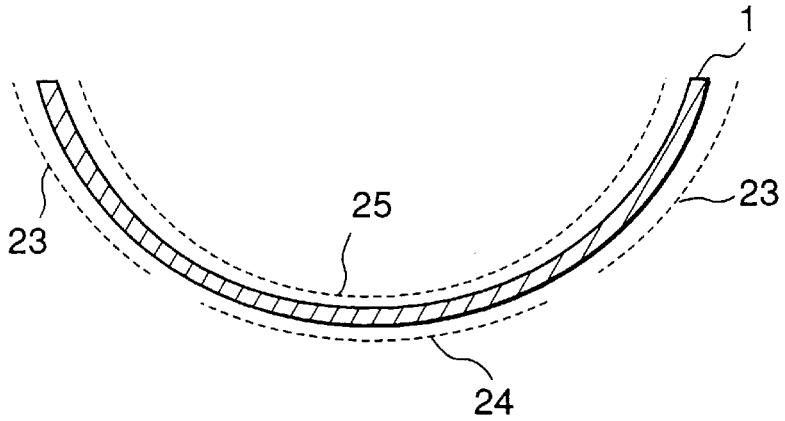
Figure 9C:
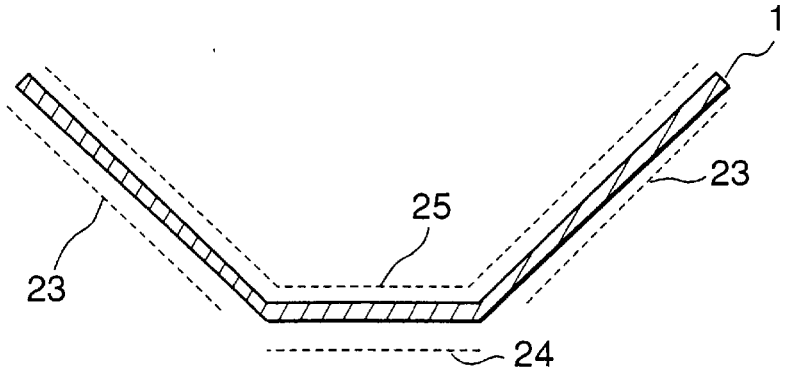
Figure 10:
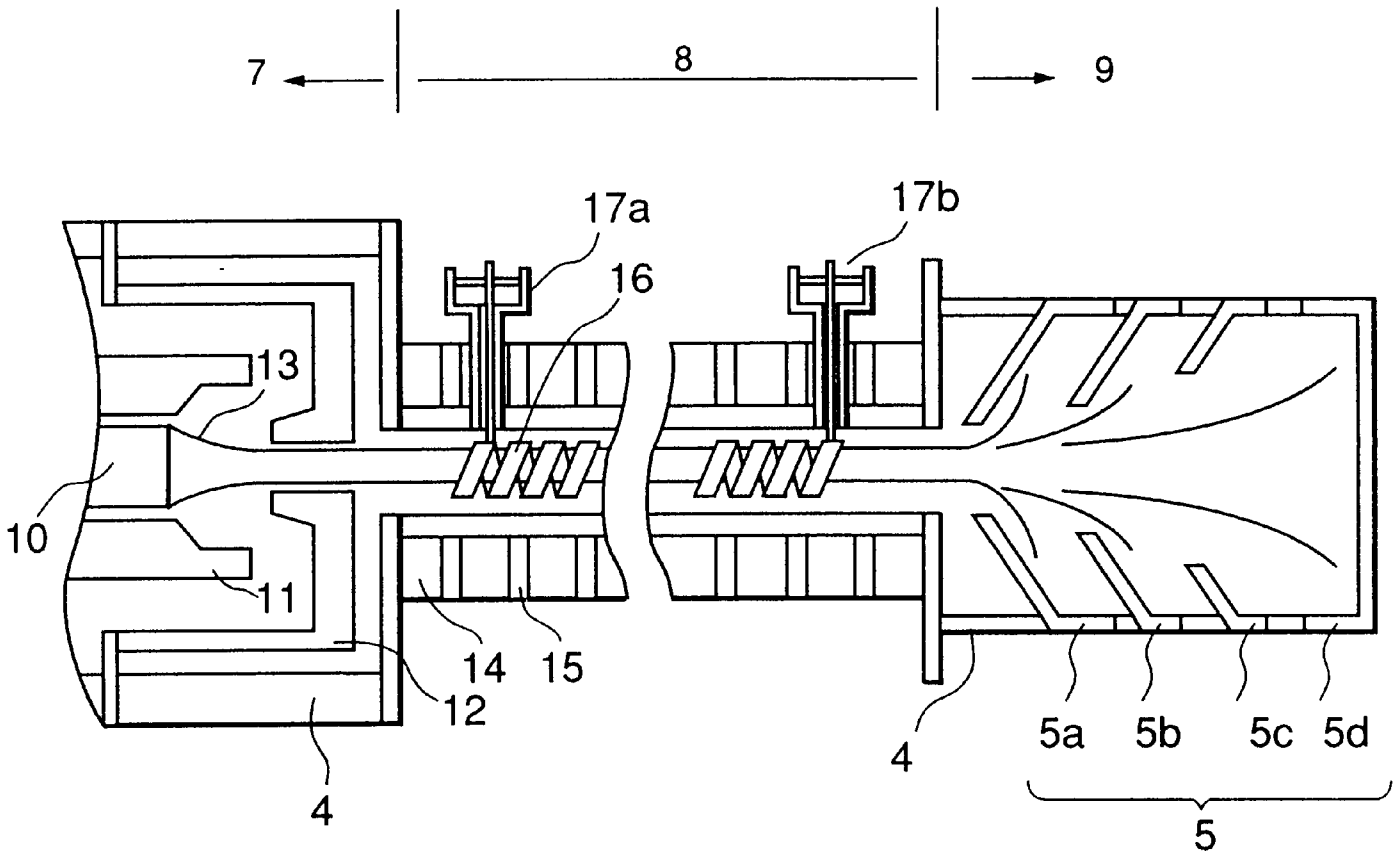
FIG. 10 (PRIOR ART)
FIG. 10 is a cross-sectional view showing a traveling-wave tube to which the heat radiator according to the present invention is attached.
Figure 11B:
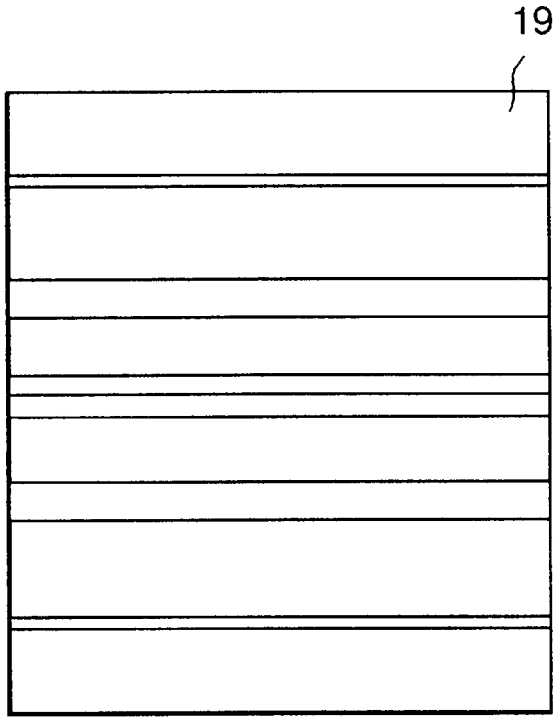
FIG. 11B (PRIOR ART)
Figure 11A:
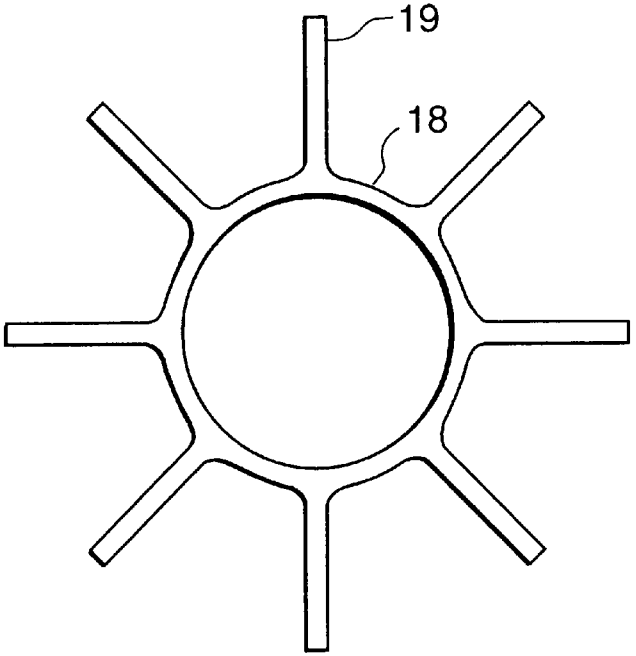
FIG. 11A (PRIOR ART)
Figure 12:
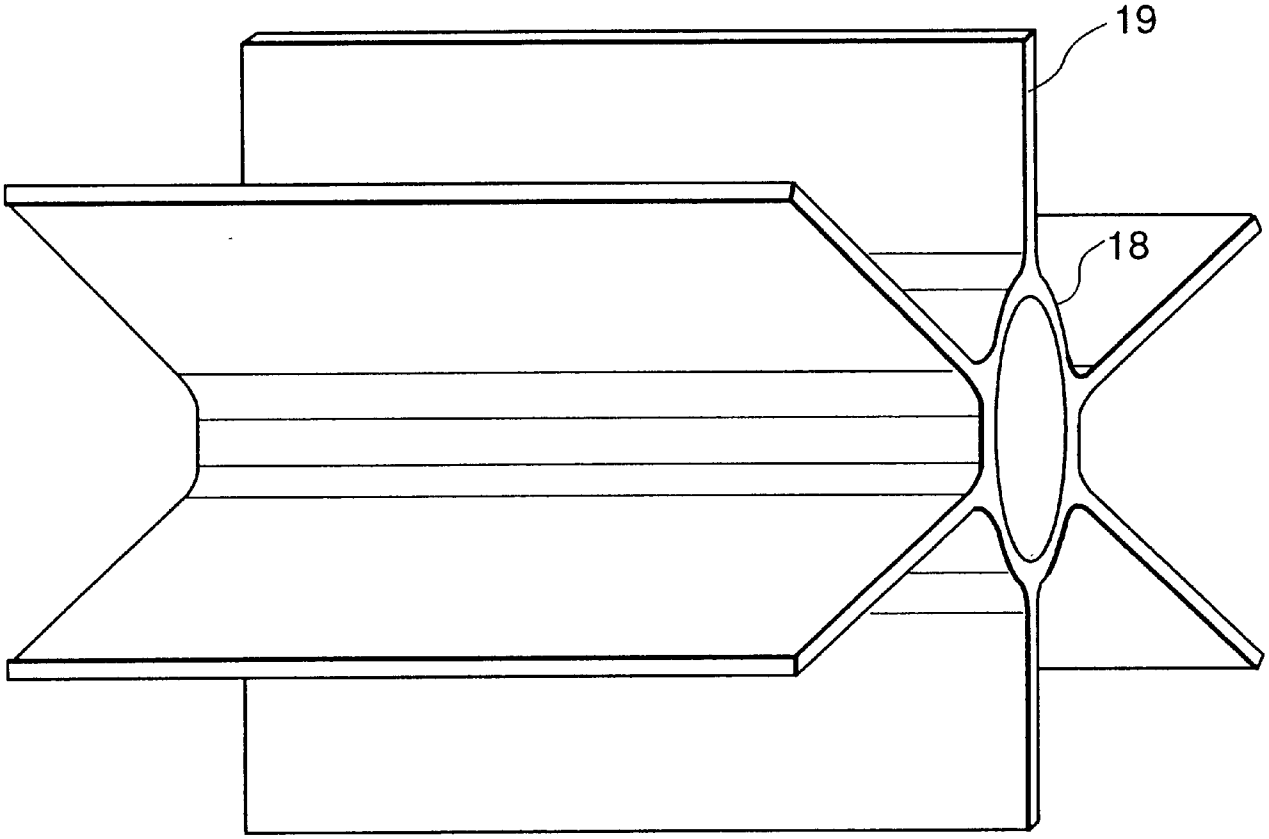
FIG. 12 (PRIOR ART)
FIG. 12 is a perspective view showing the heat radiator of FIGS. 11A and 11B.
Figure 13:
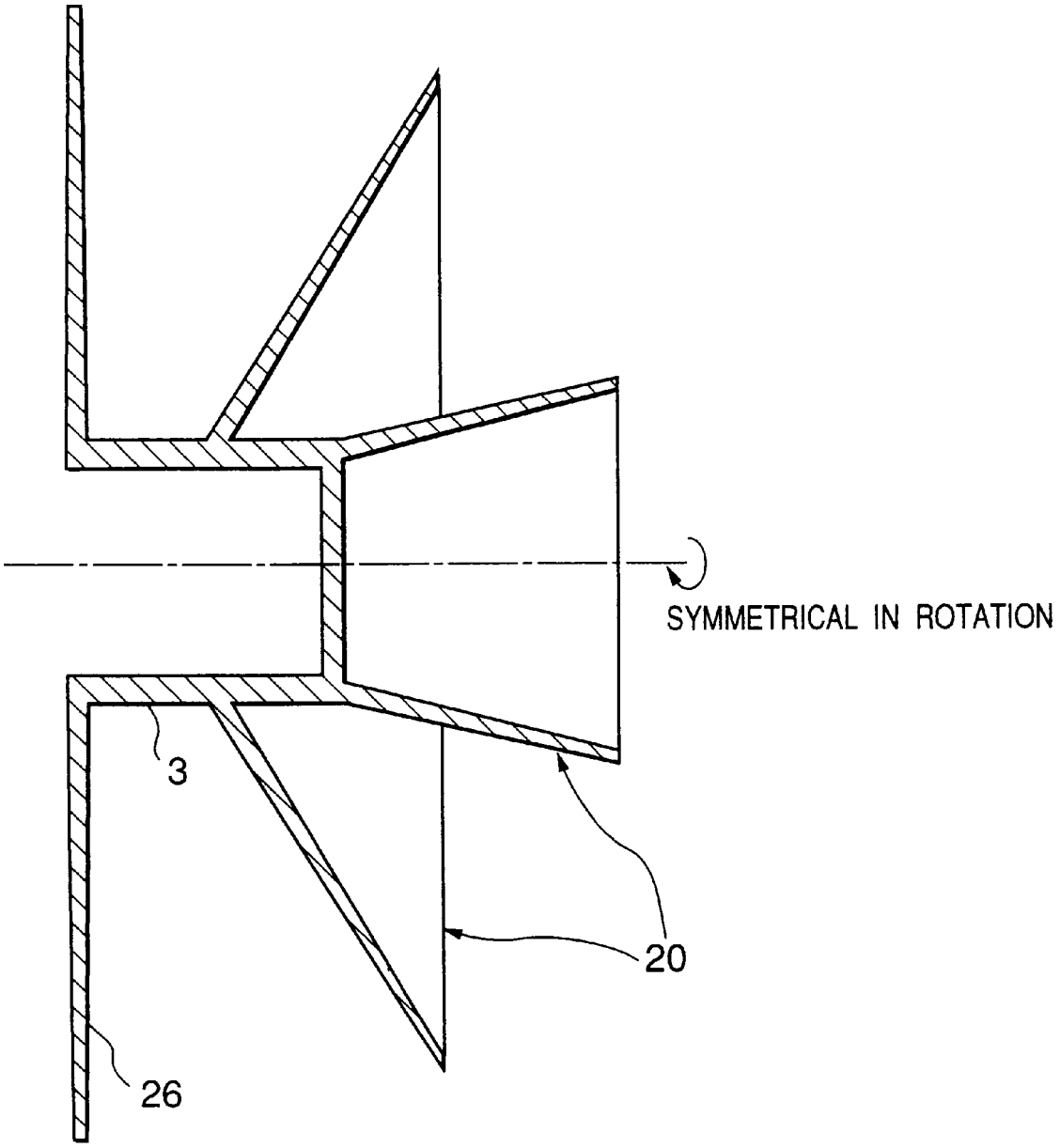
FIG. 13 (PRIOR ART)
FIG. 13 is a cross-sectional view showing another conventional emissive heat radiator.
Figure 14:
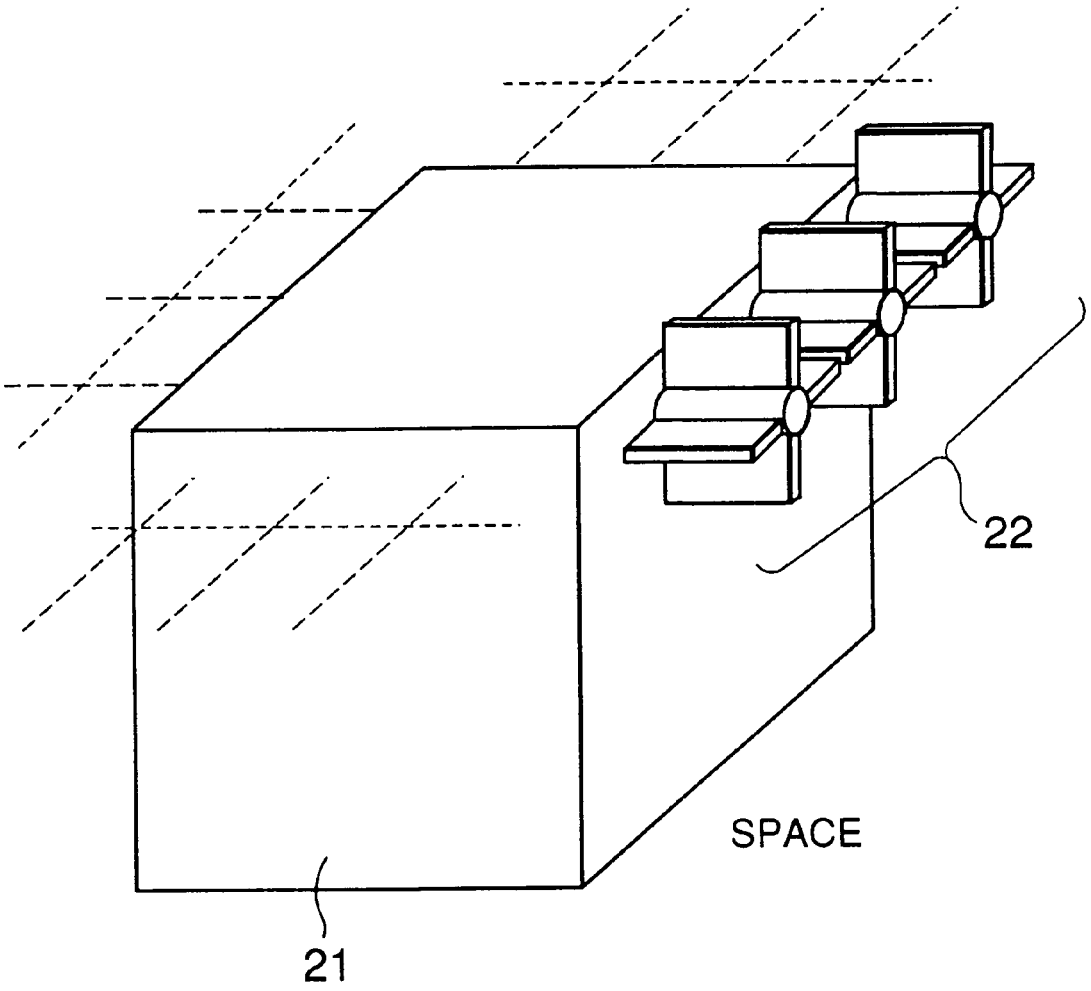
FIG. 14 (PRIOR ART)
FIG. 14 is a perspective view showing an example in which traveling-wave tubes are attached onto a satellite.

FIG. 9 is a cross-sectional view showing the semi-cylindrical radiator 1*b*. In the foregoing embodiment, the entire convex surface is subjected to the reflection surface processing, however, in this embodiment, only both end portions 23 extending along an axis of the semi-cylindrical radiator are subjected to the reflection surface processing, while the center portion 24 is subjected to the radiation surface processing. The entire concave surface 25 is subjected to the radiation surface processing likewise as other embodiments.

Since a heat is tended to be confined of a overlapped region between the radiator's 1*a* and 1*b*, the above-mentioned center portion 24 is selected to the region overlapping the cylindrical radiator 3. It is also preferable to provide such selected radiation treatment on the convex surface of the large radiator 1*a* which may corresponds to the overlapped region between two semi-cylindrical radiators 1*a* and 1*b*. In other words, the selective reflection regions is located at other than overlapping region thereof.

Although the semi-cylindrical radiator 1*a* becomes high in temperature at the time of RF output, this makes heat of the radiator 1*a* propagate to the radiator 1*b* due to radiation so that the heat can be radiated in the space from the concave 25 of the radiator 1*b* due to radiation. Also, the directivity of heat radiation is achieved by the selected partial reflection surface 23.

The above description is given to the emissive heat radiator for the traveling-wave tube. However, the present invention is also applicable to the emissive heat radiator other than the traveling-wave tube.

As is described above, the first advantage of the present invention is to obtain the sufficient directivity of heat radiation as required. The reason is because the shape of the radiator is made semi-cylindrical, and its convex surface is subjected to a reflection surface processing having a TiN coat whose absorption factor as is less than 0.1, to thereby bring the directivity of heat radiation as required.

The second advantage is to obtain the radiational cooling effect with a high performance. That is, as is described in the above embodiments, with the structure where the inner surface of the semi-cylindrical concave portion has the anodic oxide layer of 50 $\mu$m or more in thickness and 12 $\mu$m or more in the maximum surface roughness, the radiation factor characteristic $\epsilon \geqq 0.90$ can be satisfied, and heat can be efficiently radiated due to radiation. Accordingly, the heat radiation characteristic specification of the heat radiator according to the present invention is that the radiation factor characteristic is 0.90 or more at a radiation processed surface while the absorption factor is less than 0.10 at a reflection processed surface.

The reason is because allowable heat radiating direction is widened as much as possible, and effectively employing the direction, the large effective area which can radiate heat without being again absorbed by the radiator is obtained.

The third advantage is to provide a downsized radiational cooling structure. The reason is because the allowable heat radiating direction is effectively employed to thereby obtain a larger effective heat radiating area in a narrow space than the conventional emissive heat radiator structure having the directivity of only one direction.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An emissive heat radiator comprising:

a tubular member provided with a heat radiating member on an outer surface thereof, said heat radiating member having a substantially semi-cylindrical section in which a cross-section of said substantially semi-cylindrical section taken along a lengthwise axis of said tubular member forms an arcuate shape, and wherein said substantially semi-cylindrical section crosses an axis of said tubular member.

2. An emissive heat radiator comprising a tubular member provided with a heat radiating member on an outside surface thereof, said heat radiating member including a plurality of U-shaped plates and at least one flat plate, and each of said U-shaped plates being arranged along said axis of said tubular member with an intervention of said flat plate extending along said axis of said tubular member.

3. An emissive heat radiator as claimed in claim 2, wherein said U-shaped plates have different sizes.

4. An emissive heat radiator comprising a tubular member provided with a heat radiating member on an outer surface thereof, said heat radiating member having a substantially semi-cylindrical section crossing an axis of said tubular member, and at least one heat radiating plate perpendicular to an axis of said substantially semi-cylindrical section.

5. An emissive heat radiator as claimed in claim 4, wherein at least side portions extending along an axis of said semi-cylindrical section at its convex surface have a reflection surface.

6. An emissive heat radiator as claimed in claim 5, wherein a concave surface and a center portion of said convex surface have a radiation factor of at least 0.90.

7. An emissive heat radiator as claimed in claim 6, wherein said concave surface has an anodic oxide coat having a predetermined thickness and a predetermined maximum surface roughness and said reflection surface has a mirror coat having a TiN coat.

8. An emissive heat radiator comprising a tubular member provided with a heat radiating member on an outer surface thereof, said heat radiating member having a substantially semi-cylindrical section crossing an axis of said tubular member, wherein said tubular member is attached to a heating section of a microwave tube.

9. A heat radiator assembly comprising: a plurality of emissive heat radiators arranged in side by side relationship therebetween, each of said radiators having a substantially semi-cylindrical section provided on an outer surface of a tubular member such that said semi-cylindrical section crosses an axis of said tubular member, wherein each of said radiators has a proximal end disposed on said tubular member and a distal end not contacting said tubular member, wherein at least one of said radiators has a distal end that is of a greater distance from a longitudinal axis of said tubular member than a corresponding distance from said longitudinal axis of any other of said radiators, and wherein axes of said semi-cylindrical sections are arranged to extend substantially in the same direction.

10. An emissive heat radiator comprising:

a tubular member provided with a heat radiating member on an outside surface thereof, wherein said heat radiating member has a substantially semi-cylindrical shape and is disposed with a convex side of said semi-cylindrical shape extending toward an end portion of said tubular member.

11. An emissive heat radiator as claimed in claim 10, wherein said heat radiating member comprises a plurality of substantially semi-cylindrical plates arranged along a lengthwise axis of said tubular member, wherein each of said substantially semi-cylindrical plates are disposed with a convex side extending toward said end portion of said tubular member, and wherein at least one flat plate disposed on an outer surface of said tubular member extends along said lengthwise axis of said tubular member and intersects at least one of said plurality of substantially semi-cylindrical plates.

12. An emissive heat radiator as claimed in claim 11, wherein said plurality of substantially semi-cylindrical plates includes substantially semi-cylindrical plates of at least two different sizes.

13. An emissive heat radiator as claimed in claim 11, wherein said plurality of substantially semi-cylindrical plates includes substantially semi-cylindrical plates of at least two different radii of curvature.

* * * * *